US005560430A

United States Patent [19]

Enos

[11] Patent Number: 5,560,430

[45] Date of Patent: Oct. 1, 1996

[54] ADJUSTABLE STOPPER FOR A FUSIBLE LINK SPRINKLER HEAD

[76] Inventor: Adam Enos, 3091 Kahaloa Dr., Honolulu, Hi. 96822

[21] Appl. No.: 544,550

[22] Filed: Oct. 18, 1995

[51] Int. Cl.[6] ..... A62C 37/20

[52] U.S. Cl. ..... 169/90

[58] Field of Search ..... 169/90

[56] References Cited

U.S. PATENT DOCUMENTS

| | | | |
|---|---|---|---|
| 890,356 | 6/1908 | Grode | 169/90 |
| 2,234,290 | 3/1941 | Tessier | 169/90 |
| 2,417,265 | 3/1947 | Nelsen et al. | 169/90 |
| 2,466,126 | 4/1949 | Siegel | 169/90 |
| 2,538,485 | 1/1951 | Tessier | 169/90 |
| 2,700,423 | 1/1955 | Burkert | 169/90 |
| 2,743,782 | 5/1956 | Occhipinti | 169/90 |
| 3,191,685 | 6/1965 | Warne | 169/90 |
| 3,976,141 | 8/1976 | Harrington | 169/90 |

*Primary Examiner*—Gary C. Hoge

[57] ABSTRACT

An adjustable stopper for a fusible link sprinkler head comprised of an elongated upper rectangular plate. The device includes an elongated lower rectangular plate. A rocker assembly is positioned between the upper plate and the lower plate. A hemispherical stopper is secured to a proximal end portion of the upper rectangular plate. The stopper is dimensioned to fit into a sprinkler head orifice. An adjustment assembly extends through the upper plate and the lower plate.

5 Claims, 3 Drawing Sheets

FIG 3
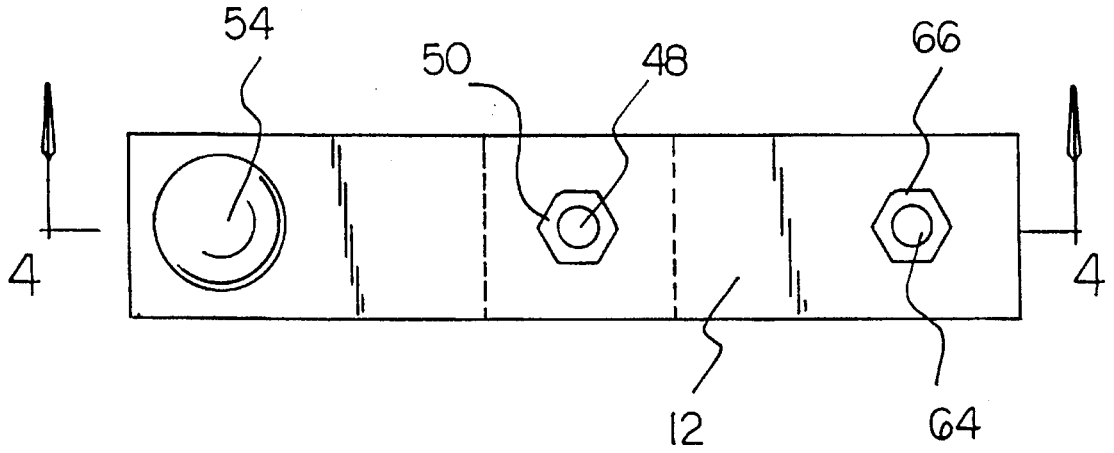
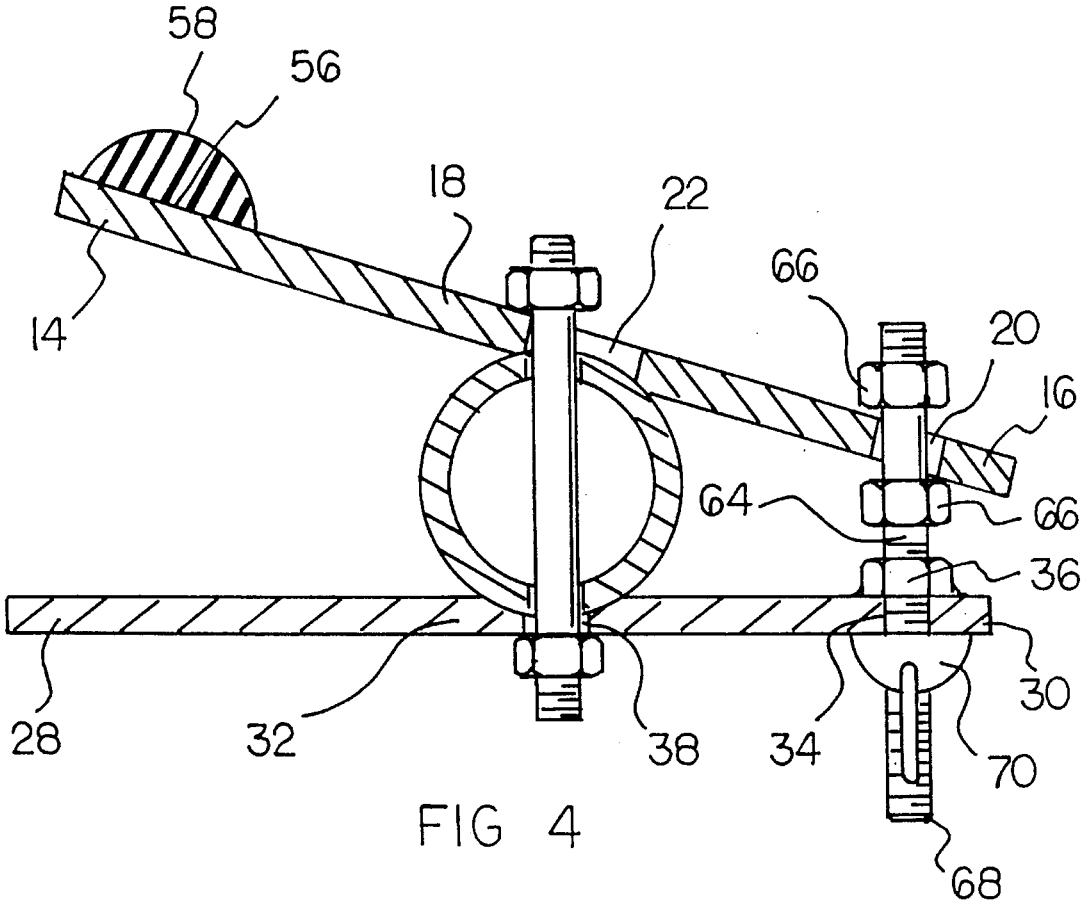
FIG 4

ADJUSTABLE STOPPER FOR A FUSIBLE LINK SPRINKLER HEAD

BACKGROUND OF THE INVENTION

1. Field of the Invention

The present invention relates to an adjustable stopper for a fusible link sprinkler head and more particularly pertains to stopping flow of water from a sprinkler head with an adjustable stopper for a fusible link sprinkler head.

2. Description of the Prior Art

The use of sprinkler shut-off devices is known in the prior art. More specifically, sprinkler shut-off devices heretofore devised utilized for the purpose of shutting off the flow of water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 2,538,485 to Tessier discloses a universal device for shutting off sprinkler nozzles.

U.S. Pat. No. 2,234,290 to Tessier discloses a sprinkler head shutoff device.

U.S. Pat. No. 890,856 to Grode discloses a stop for sprinkler heads.

U.S. Pat. No. 2,700,423 to Burkert discloses a sprinkler head shutoff.

U.S. Pat. No. 3,550,687 to Thaxton discloses an automatic sprinkler shut-off device.

U.S. Pat. No. 4,191,257 to Mohler discloses a sprinkler-sealing device.

U.S. Pat. No. 4,638,866 to Capasso et al. discloses a fire-sprinkler cut-off device.

While these devices fulfill their respective, particular objective and requirements, the aforementioned patents do not describe an adjustable stopper for a fusible link sprinkler head for stopping flow of water from a sprinkler head.

In this respect, the adjustable stopper for a fusible link sprinkler head according to the present invention substantially departs from the conventional concepts and designs of the prior art, and in doing so provides an apparatus primarily developed for the purpose of stopping flow of water from a sprinkler head.

Therefore, it can be appreciated that there exists a continuing need for new and improved adjustable stopper for a fusible link sprinkler head which can be used for stopping flow of water from a sprinkler head. In this regard, the present invention substantially fulfills this need.

SUMMARY OF THE INVENTION

In the view of the foregoing disadvantages inherent in the known types of sprinkler shut-off devices now present in the prior art. The present invention provides an improved adjustable Stopper for a fusible link sprinkler head. As such, the general purpose of the present invention, which will be described subsequently in greater detail, is to provide a new and improved adjustable stopper for a fusible link sprinkler head and method which has all the advantages of the prior art and none of the disadvantages.

To attain this, the present invention essentially comprises an elongated upper rectangular plate having a proximal end portion, a distal end portion, and an intermediate portion therebetween. The distal end portion has an aperture therethrough. The intermediate portion has an aperture therethrough. The device includes an elongated lower rectangular plate having a proximal end portion, a distal end portion, and an intermediate portion therebetween. The distal end portion of the lower plate has an aperture therethrough. The aperture of the distal end portion of the lower plate has a nut secure to an upper surface thereof. The intermediate portion of the lower plate has an aperture therethrough. The device includes a rocker assembly comprised of a hollow cylindrical barrel positioned between the intermediate portions of the upper plate and the lower plate. The cylindrical barrel has a bolt extending therethrough with end portions of the bolt extending outwardly of the apertures within the intermediate portions of the upper plate and the lower plate. The bolt is secured through the cylindrical barrel by a pair of nuts secured to the end portions thereof. The device includes a hemispherical stopper having a planar lower end and a rounded upper end. The planar lower end is secured to the proximal end portion of the upper rectangular plate. The rounded upper end is dimensioned to fit into a sprinkler head orifice. The device includes an adjustment assembly comprised of a threaded bolt extending through the apertures through the distal end portions of the upper plate and the lower plate. The threaded bolt has nuts coupled thereto on opposing sides of the distal end portion of the upper plate. A lower end portion of the threaded bolt has a wing nut coupled thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable stopper for a fusible link sprinkler head which has all the advantages of the prior art sprinkler shut-off devices and none of the disadvantages.

It is another object Of the present invention to provide a new and improved adjustable stopper for a fusible link sprinkler head which may be easily and efficiently manufactured and marketed.

It is a further object of the present invention to provide a new and improved adjustable stopper for a fusible link sprinkler head which is of durable and reliable construction.

An even further object of the present invention is to provide a new and improved adjustable stopper for a fusible link sprinkler head which is susceptible of a low cost of manufacture with regard to both materials and labor, and which accordingly is then susceptible of low prices of sale to the consuming public, thereby making such an adjustable stopper for a fusible link sprinkler head economically available to the buying public.

Still yet another object of the present invention is to provide a new and improved adjustable stopper for a fusible link sprinkler head which provides in the apparatuses and methods of the prior art some of the advantages thereof, while simultaneously overcoming some of the disadvantages normally associated therewith.

An object of the present invention is to provide a new and improved adjustable stopper for a fusible link sprinkler head for stopping flow of water from a sprinkler head.

Another object of the present invention to provide a new and improved adjustable stopper for a fusible link sprinkler head comprised of an elongated upper rectangular plate. The device includes an elongated lower rectangular plate. A rocker assembly is positioned between the upper plate and the lower plate. A hemispherical stopper is secured to a proximal end portion of the upper rectangular plate. The stopper is dimensioned to fit into a sprinkler head orifice. An adjustment assembly extends through the upper plate and the lower plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a cross-sectional side view of the preferred embodiment of the present invention taken along line 4—4 of FIG. 3.

The same reference numerals refer to the same parts through the various Figures.

DESCRIPTION OF THE PREFERRED EMBODIMENT

Figure 1:
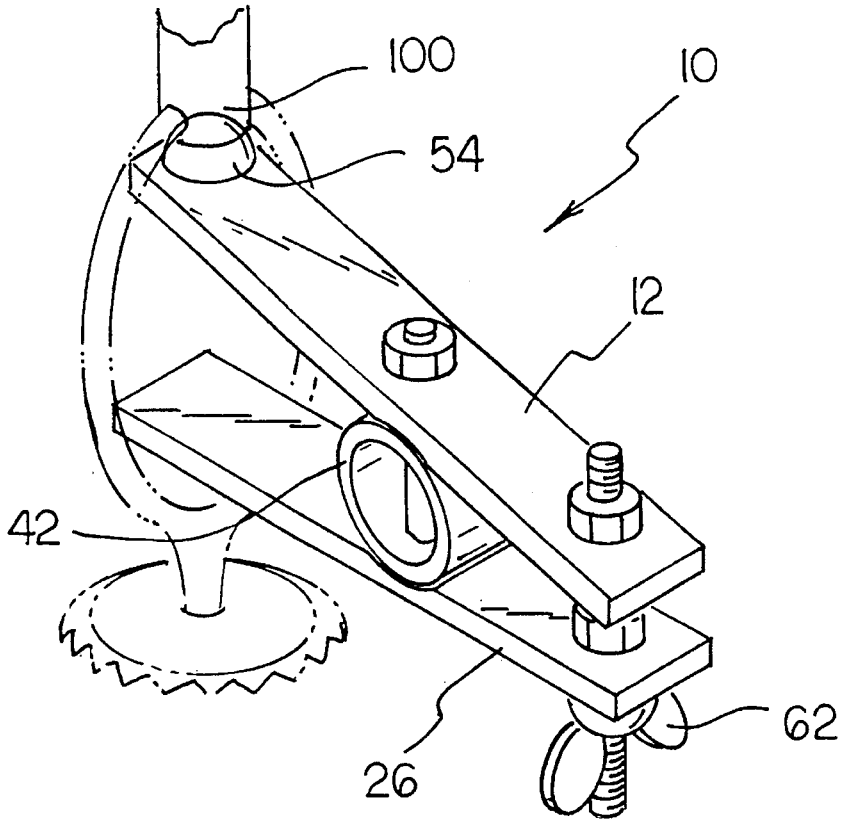
FIG. 1 is a perspective view of the preferred embodiment of the adjustable stopper for a fusible link sprinkler head constructed in accordance with the principles of the present invention.
Figure 2:
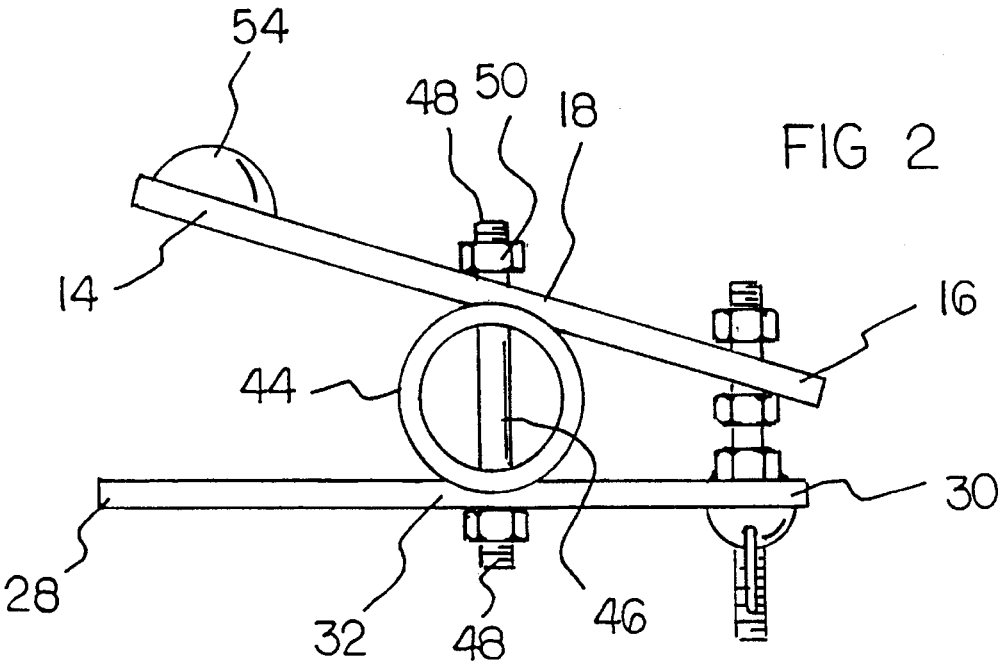
FIG. 2 is a side elevation view of the preferred embodiment of the present invention.

With reference now to the drawings, and in particular, to FIGS. 1–6 thereof, the preferred embodiment of the new and improved adjustable stopper for a fusible link sprinkler head embodying the principles and concepts of the present,invention and generally designated by the reference number 10 will be described.

Specifically, it will be noted in the various Figures that the device relates to a new and improved adjustable stopper for a fusible link sprinkler head for stopping flow of water,from a sprinkler head. In its broadest context, the device consists of an elongated upper rectangular plate, an elongated lower rectangular plate, a rocker assembly, a hemispherical stopper, and an adjustment assembly. Such components are individually configured and correlated with respect to each other so as to attain the desired objective.

The device 10 includes an elongated upper rectangular plate 12 having a proximal end portion 14, a distal end portion 16, and an intermediate portion 18 therebetween. The distal end portion 16 has an aperture 20 therethrough. The intermediate portion 18 has an aperture 22 therethrough. The dimensions of the upper plate 12 is six inches in length and ¾ inches wide.

The device 10 includes an elongated lower rectangular plate 26 having a proximal end portion 28, a distal end portion 30, and an intermediate portion 32 therebetween. The distal end portion 30 of the lower plate 26 has an aperture 34 therethrough. The aperture 34 of the distal end portion 30 of the lower plate 26 has a nut 36 secured to an upper,surface thereof. The intermediate portion 32 of the lower plate 26 has an aperture 38 therethrough. The lower plate 26 is of the same dimensions as that of the upper plate 12.

The device 10 includes a rocker assembly 42 comprised of a hollow cylindrical barrel 44 positioned between the intermediate portions 18, 32 of the upper plate 12 and the lower plate 26. The cylindrical barrel 44 has a bolt 46 extending therethrough with end portions 48 of the bolt 46 extending outwardly of the apertures 22, 38 within the intermediate portions 18, 32 of the upper plate 12 and the lower plate 26. The bolt 46 is secured through the cylindrical barrel 44 by a pair of nuts 50 secured to the end portions 48 thereof. The positioning of the cylindrical barrel 44 can be varied along the lengths of the upper plate 12 and the lower plate 26 to maximize the distance between each other when one of the ends are biased together.

The device 10 includes a hemispherical stopper 54 having a planar lower end 56 and a rounded upper end 58. The planar lower end 56 is secured to the proximal end portion 14 of the upper rectangular plate 12. The rounded upper end 58 is dimensioned to fit into a sprinkler head orifice 100. The hemispherical stopper 54 preferably has a diameter of about ¾ inch to correspond to the size of sprinkler head orifices. The hemispherical stopper 54 is fabricated of a hard rubber or neoprene material.

The device 10 includes an adjustment assembly 62 comprised of a threaded bolt 64 extending through the apertures 20, 34 through the distal end portions 16, 30 of the upper plate 12 and the lower plate 26. The threaded bolt 64 has nuts 66 coupled thereto on opposing sides of the distal end portion 16 of their upper plate 12. A lower end portion 68 of the threaded bolt 64 has a wing nut 70 coupled thereto. The user Simply tightens the wing nut 70 which will cause the distal end portions 16, 30 of the upper plate 12 and the lower plate 26 to bias towards each other and thereby causing the proximal end portion 14 of the upper plate 12 to raise thereby causing the hemispherical stopper 54 to block the sprinkler head orifice 100 which will stop,the flow of water.

Figure 5:
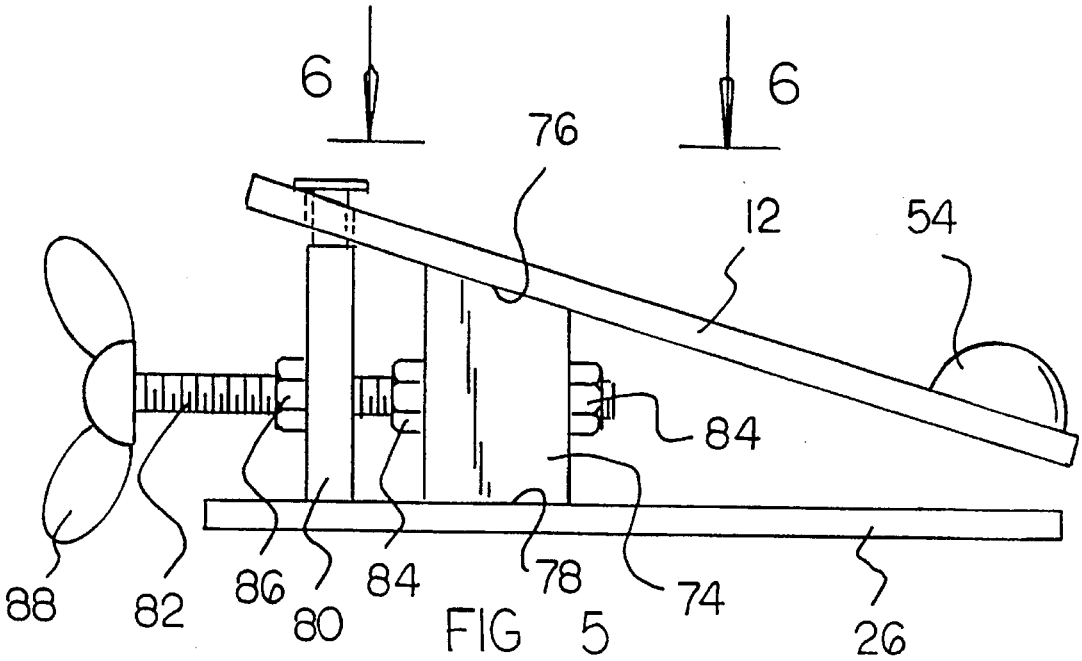
FIG. 5 is a side elevation view of the second embodiment of the present invention.
Figure 6:
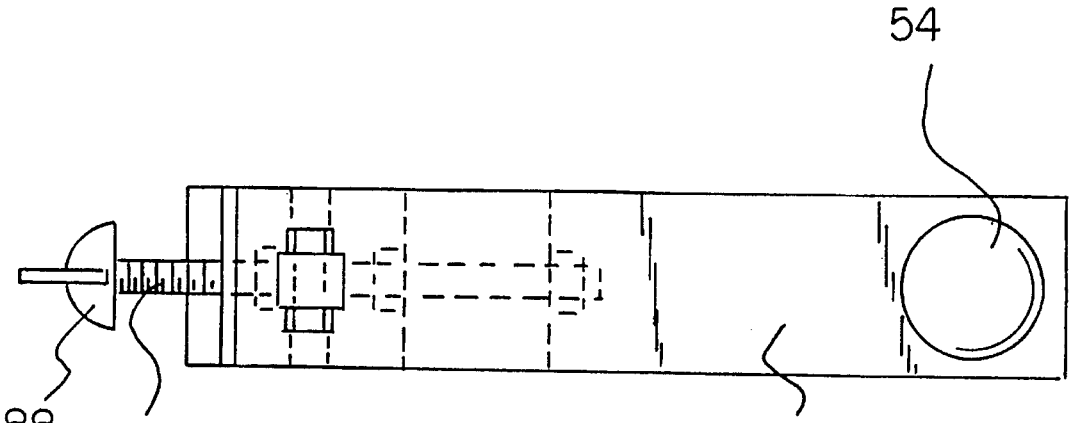
FIG. 6 is a plan view of the second embodiment of the present invention as taken along line 6—6 of FIG. 5.

A second embodiment of the present invention is shown in FIGS 5 and 6 and includes substantially all of the components of the present invention further including wherein the rocker assembly 42 is comprised of a wedge 74 having an inclined upper end 76 and a planar lower end 78. The wedge 74 is slidably positioned between the upper plate 12 and the lower plate 26. The adjustment assembly 62 is comprised of a pivot pin 80 secured between distal end portions 16, 30 of the upper plate 12 and the lower plate 26. The adjustment assembly 62 has a threaded bolt 82 extending laterally through the pivot pin 80 and the wedge 74 of the rocker assembly 42. The threaded bolt 82 has nuts 84 secured thereto on opposing sides of the wedge 74. The threaded bolt 82 has a nut 86 secured thereto outwardly of the pivot pin 80. The threaded bolt 82 has a wing nut 88 secured to an end portion thereof. The user simply tightens the wing nut 88 which will cause the wedge 74 to slide between the upper plate 12 and the lower plate 26 thereby causing the proximal end 14 of the upper plate 12 to raise upwardly to couple the hemispherical stopper 54 with the sprinkler head orifice 100.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable stopper for a fusible link sprinkler head for stopping flow of water from a sprinkler head comprising, in combination:

an elongated upper rectangular plate having a proximal end portion, a distal end portion, and an intermediate portion therebetween, the distal end portion having an aperture therethrough, the intermediate portion having an aperture therethrough;

an elongated lower rectangular plate having a proximal end portion, a distal end portion, and an intermediate portion therebetween, the distal end portion of the lower plate having an aperture therethrough, the aperture of the distal end portion of the lower plate having a nut secured to an upper surface thereof, the intermediate portion of the lower plate having an aperture therethrough;

a rocker assembly comprised of a hollow cylindrical barrel positioned between the intermediate portions of the upper plate and the lower plate, the cylindrical barrel having a bolt extending therethrough with end portions of the bolt extending outwardly of the apertures within the intermediate portions of the upper plate and the lower plate, the bolt being secured through the cylindrical barrel by a pair of nuts secured to the end portions thereof;

a hemispherical stopper having a planar lower end and a rounded upper end, the planar lower end secured to the proximal end portion of the upper rectangular plate, the rounded upper end being dimensioned to fit into a sprinkler head orifice;

an adjustment assembly comprised of a threaded bolt extending through the apertures through the distal end portions of the upper plate and the lower plate, the threaded bolt having nuts coupled thereto on opposing sides of the distal end portion of the upper plate, a lower end portion of the threaded bolt having a wing nut coupled thereto.

2. An adjustable stopper for a fusible link sprinkler head comprising:

an elongated upper rectangular plate;

an elongated lower rectangular plate;

a rocker assembly positioned between the upper plate and the lower plate;

a hemispherical stopper secured to a proximal end portion of the upper rectangular plate, the stopper being dimensioned to fit into a sprinkler head orifice; and an adjustment assembly extending through the upper plate and the lower plate wherein the rocker assembly further comprised of a hollow cylindrical barrel positioned between intermediate portions of the upper plate and the lower plate, the cylindrical barrel having a bolt extending therethrough with end portions of the bolt extending outwardly of the intermediate portions of the upper plate and the lower plate, the bolt being secured through the cylindrical barrel by a pair of nuts secured to the end portions thereof.

3. An adjustable stopper for a fusible link sprinkler head comprising:

an elongated upper rectangular plate;

an elongated lower rectangular plate;

a rocker assembly positioned between the upper plate and the lower plate;

a hemispherical stopper secured to a proximal end portion of the upper rectangular plate, the stopper being dimensioned to fit into a sprinkler bead orifice; and an adjustment assembly extending through the upper plate and the lower plate wherein the adjustment assembly comprised of a threaded bolt extending through distal end portions of the upper plate and the lower plate, the threaded bolt having nuts coupled thereto on opposing sides of the distal end portion of the upper plate, a lower end portion of the threaded bolt having a wing nut coupled thereto.

4. An adjustable stopper for a fusible link sprinkler head comprising:

an elongated upper rectangular plate;

an elongated lower rectangular plate;

a rocker assembly positioned between the upper plate and the lower plate;

a hemispherical stopper secured to a proximal end portion of the upper rectangular plate, the stopper being dimensioned to fit into a sprinkler head orifices; and an adjustment assembly extending through the upper plate and the lower plate wherein the rocker assembly further comprising wedge having an inclined upper end and a planar lower end, the wedge slidably positioned between the upper plate and the lower plate.

5. The adjustable stopper as set forth in claim 4 wherein the adjustment assembly further comprising a pivot pin secured between distal end portions of the upper plate and the lower plate, the adjustment assembly having a threaded bolt extending laterally through the pivot pin and the wedge of the rocker assembly, the threaded bolt having nuts secured thereto on opposing sides of the wedge, the threaded bolt having a nut secured thereto outwardly of the pivot pin, the threaded bolt having a wing nut secured to an end portion thereof.

* * * * *